US011454933B2

(12) United States Patent
Born et al.

(10) Patent No.: US 11,454,933 B2
(45) Date of Patent: Sep. 27, 2022

(54) TIMEPIECE REGULATING MECHANISM WITH ARTICULATED RESONATORS

(71) Applicant: The Swatch Group Research and Development Ltd, Marin (CH)

(72) Inventors: Jean-Jacques Born, Morges (CH); Pascal Winkler, St-Blaise (CH); Gianni Di Domenico, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 807 days.

(21) Appl. No.: 16/364,853

(22) Filed: Mar. 26, 2019

(65) Prior Publication Data

US 2019/0332056 A1 Oct. 31, 2019

(30) Foreign Application Priority Data

Apr. 25, 2018 (EP) ..... 18169314

(51) Int. Cl.
*G04B 15/08* (2006.01)
*G04B 17/32* (2006.01)

(52) U.S. Cl.
CPC ..... *G04B 15/08* (2013.01); *G04B 17/32* (2013.01)

(58) Field of Classification Search
CPC ..... G04B 17/32; G04B 15/08
See application file for complete search history.

(56) References Cited

U.S. PATENT DOCUMENTS

| | | | | |
|---|---|---|---|---|
| 3,520,127 | A | 7/1970 | Meyer | |
| 9,052,693 | B2 * | 6/2015 | Kawauchiya | G04B 17/285 |
| 10,520,890 | B2 * | 12/2019 | Semon | G04B 17/045 |
| 2015/0203985 | A1 * | 7/2015 | Stranczl | C30B 1/10 117/9 |

(Continued)

FOREIGN PATENT DOCUMENTS

| | | |
|---|---|---|
| CN | 106444335 A | 2/2017 |
| EP | 3 128 380 A1 | 2/2017 |

(Continued)

OTHER PUBLICATIONS

Combined Chinese Office Action and Search Report dated Aug. 12, 2020, in Patent Application No. 201910334207.5 (with English translation), 12 pages.

(Continued)

*Primary Examiner* — Edwin A. Leon
*Assistant Examiner* — Kevin Andrew Johnston
(74) *Attorney, Agent, or Firm* — Oblon, McClelland, Maier & Neustadt, L.L.P.

(57) ABSTRACT

A timepiece regulating mechanism including primary resonators each with an inertial weight suspended by flexible strips to a fixed structure with respect to which this weight pivots, and mechanical device of synchronizing the primary resonators which include, between the inertial weights, an articulated connection which, under normal conditions, allows pivoting of the inertial weights in opposite directions of rotation and with close rotation angles, and during a shock, prevents pivoting thereof in the same direction of rotation, the mechanism including an oscillator with a frictional rest escapement mechanism arranged to cooperate alternately with the primary resonators, on pallet stones of the inertial weights.

11 Claims, 5 Drawing Sheets

(56) References Cited

U.S. PATENT DOCUMENTS

| | | | | |
|---|---|---|---|---|
| 2016/0179058 | A1* | 6/2016 | Born | G04B 17/04 368/167 |
| 2017/0010586 | A1* | 1/2017 | Di Domenico | G04B 17/045 |
| 2017/0038730 | A1* | 2/2017 | Winkler | G04B 17/06 |
| 2017/0123380 | A1* | 5/2017 | Winkler | G04B 17/066 |
| 2017/0220002 | A1* | 8/2017 | Helfer | G04B 17/10 |
| 2017/0227930 | A1* | 8/2017 | Di Domenico | G04B 15/02 |
| 2017/0261933 | A1* | 9/2017 | Favre | G04C 3/063 |

FOREIGN PATENT DOCUMENTS

| | | |
|---|---|---|
| EP | 3 206 089 A1 | 8/2017 |
| FR | 1.574.359 | 7/1969 |
| FR | 2 928 015 | 8/2009 |

OTHER PUBLICATIONS

European Search Report dated Nov. 26, 2018 in European Application 18169314.4 filed on Apr. 25, 2018 (with English translation of categories of Cited Documents).

* cited by examiner

TIMEPIECE REGULATING MECHANISM WITH ARTICULATED RESONATORS

CROSS-REFERENCE TO RELATED APPLICATION

This application claims priority to European Patent Application No. 18169314.4 filed on Apr. 25, 2018, the entire disclosure of which is hereby incorporated herein by reference.

FIELD OF THE INVENTION

The invention concerns a timepiece regulating mechanism comprising a plurality of primary resonators each including at least one inertial weight which is pivotable with respect to a fixed structure to which said inertial weight is suspended by a plurality of flexible strips.

The invention also concerns a timepiece movement comprising at least one such regulating mechanism.

The invention also concerns a watch including at least one such movement and/or including at least one such regulating mechanism.

The invention concerns the field of regulating mechanisms for mechanical horology.

BACKGROUND OF THE INVENTION

Timepiece oscillator and resonator technology has evolved significantly with the emergence of techniques for making components from silicon or materials with similar characteristics, which have allowed the advent of monolithic articulated structures or flexible bearings, in particular having strips, which form virtual pivots and obviate the need for conventional pivots, which use energy, are subject to wear and require appropriate lubrication.

However, many parameters still require improvement: low oscillation amplitudes, transmission of high stresses, shock sensitivity and generally, sensitivity to disturbance during wear, in particular with respect to rotation.

French Patent Application No FR2928015A1 in the name of LENOBLE discloses a tangential impulse pallet escapement device for watches, including a toothed escape wheel, pallets and at least one balance/balance spring, the pallets are in two parts, each pivoting on a distinct axis, the two parts are articulated to one another via two transmission arms terminating at their adjacent ends in a common articulation, so that the two parts of the pallets rotate at the same speed but in opposite directions, each part of the pallets including a locking-face and an impulse-face, the latter receiving impulses from the escape wheel teeth in a tangential manner. This device includes two balance/balance springs with distinct axes of oscillatory rotation, and each part of the pallets comprises a fork able to drivably engage on an impulse pin of the corresponding balance/balance spring.

European Patent Application No EP3206089A1 in the name of THE SWATCH GROUP RESEARCH AND DEVELOPMENT Ltd discloses a timepiece resonator mechanism comprising a first support with a first anchor and a second anchor to which is attached a flexural pivot mechanism, which defines a virtual pivot axis about which rotatably pivots a pivoting weight, and which includes at least one front RCC flexural pivot and one back RCC flexural pivot, mounted in series and head-to-tail relative to each other about said virtual pivot axis, said front RCC flexural pivot includes, between the first support and an intermediate rotary support, two straight flexible front strips of the same front length between the clamp points thereof, defining two linear front directions which intersect at the virtual pivot axis and which define therewith a front angle, and wherein the respective anchors of the two straight flexible front strips farthest from the virtual pivot axis are both at the same front distance from the virtual pivot axis. The back RCC flexural pivot includes, between the intermediate rotary support, which includes a third anchor and a fourth anchor, and the pivoting weight, two straight flexible back strips of the same back length between the clamping points thereof, defining two linear back directions which intersect at the virtual pivot axis and which define therewith a back angle, and wherein the respective anchors of the two straight flexible back strips farthest from the virtual pivot axis are both at a same back distance from the virtual pivot axis. This flexural pivot mechanism is planar, and the centre of inertia of the assembly formed by the pivoting weight and any added inertial weight carried by the pivoting weight is on the virtual pivot axis or in immediate proximity thereto. The front angle expressed in degrees is determined by inequalities based on the front lengths and front distances and the back angle expressed in degrees is determined by similar inequalities based on the back lengths and back distances.

European Patent Application No EP3128380A1 discloses a timepiece regulating mechanism comprising a plate and, mounted to move at least in a pivoting motion with respect to said plate, an escape wheel set that pivots about an axis of escapement and is subjected to a drive torque, and at least a first resonator comprising a first stiff structure connected to the plate by first elastic return means. The first stiff structure carries at least one inertia arm, wherein a first inertia arm is arranged to cooperate with the escape wheel set via magnetically and/or electrically charged tracks comprised in both the at least one first inertia arm and the escape wheel set, to form a synchronizing device between the escape wheel set and the first resonator. The synchronizing device is protected from loss of synchronization when there is an accidental increase in torque by a mechanical anti-desynchronization mechanism comprising mechanical escapement stops carried by the escape wheel set and by at least one mechanical inertia arm stop carried by the first inertia arm, and together arranged to maintain a stopped position in the event of accidental torque increase.

French Patent Application No FR1574359A in the name of MEYER discloses an elastic oscillator comprising a fixed support and at least one rotary member and springs disposed radially with respect to the rotary member, fixed, on the one hand to the support and on the other, to the rotary member. The configuration of the springs is such that, within the limits of their useful oscillation amplitude, at their points of contact with the rotary member, these springs describe an arc of a circle whose centre is on the axis of rotation of the rotary member. The springs have a prismatic shape, their length is equal to 1.5 times the arc radius value. The rotary member is fixed to the support by two spring elements disposed at 90° relative to one another, or by three spring elements disposed at 120° relative to one another. A common support can carry two rotary members placed one beside the other and oscillating in opposite directions. The rotary members can comprise meshing members determining the direction of oscillation. The rotary members can be actuated by a common magnetic system. A common support can carry two coaxial rotary members oscillating in opposite directions.

SUMMARY OF THE INVENTION

The invention proposes to make a regulator having flexural pivots for mechanical watches, which is insensitive to these disturbances during wear, which is insensitive to shocks, easy to produce, and has the best possible efficiency by minimising friction.

To this end, the invention concerns a timepiece regulating mechanism according to claim 1.

The invention also concerns a timepiece movement comprising at least one such regulating mechanism.

The invention also concerns a watch including at least one such movement and/or including at least one such regulating mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
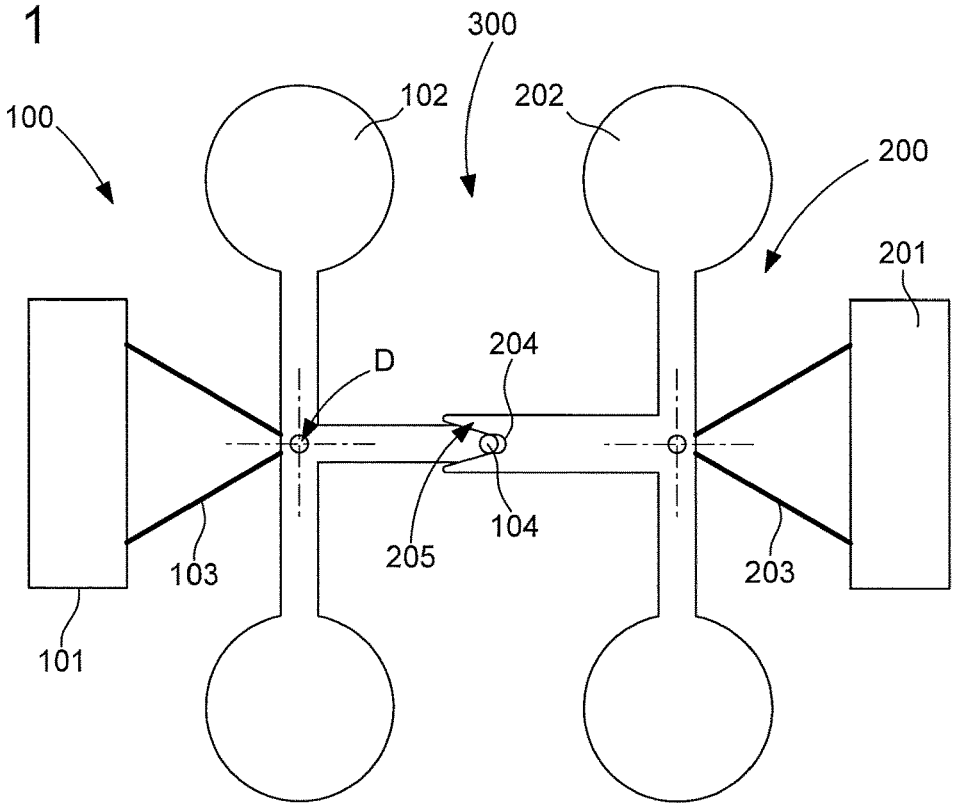
FIG. 1 represents a schematic, plan view of a regulating mechanism according to the invention, comprising two resonators each including an inertial weight suspended by flexible strips, which weights define together an articulated connection with play, in a first angular rest position of each resonator.

The invention concerns a timepiece regulating mechanism 300 comprising a plurality of primary resonators 100, 200. This display mechanism 300 is a mechanism with articulated resonators.

The invention is applicable, in particular but not exclusively, to resonators on short-stroke flexural pivots for mechanical watches, which are usually very sensitive to disturbance during wear, and particularly very sensitive to angular accelerations, especially in rotation.

The Figures only illustrate, in a non-limiting manner, the variant with two such primary resonators 100, 200, but those skilled in the art will have no difficulty in extrapolating the features of the invention to a higher number of resonators.

These primary resonators 100, 200 each include at least one inertial weight 102, 202, which is pivotable with respect to a fixed structure 101, 201, to which inertial weight 102, 202 is suspended by a plurality of flexible strips 103, 203. These flexible strips define, in a known manner, a virtual pivot axis about which the inertial weight concerned pivots, with a very small distance, of several micrometres or tens of micrometres, in particular less than 30 micrometres, between the position of the instantaneous pivot axis and the theoretical pivot axis dictated by the shape and position of the flexible strips.

According to the invention, this regulating mechanism 300 includes mechanical means for synchronizing at least two such primary resonators 100, 200. These mechanical synchronizing means include an articulated connection between two inertial weights 102, 202 comprised in the two primary resonators 100, 200.

This articulated connection is arranged, under normal conditions, to allow pivoting of the two inertial weights 102, 202, in opposite directions of rotation, and with close rotation angle values. The articulated connection is arranged, in case of shock, to prevent pivoting of the two inertial weights 102, 202 in the same direction of rotation.

In a particular embodiment, this articulated connection has some play.

More particularly and in a non-limiting manner, and as seen in FIGS. 1 to 8, this articulated connection results from the cooperation between a pin or suchlike and a groove of suitable shape: more particularly, one of the two inertial weights 102, 202, includes a pin 104, which slides with play in a slot 204 comprised in the other of the two inertial weights 102, 202. This slot 204 is V-shaped, so as to allow, under normal conditions, pivoting of the two inertial weights 102, 202, in opposite directions of rotation and with the same rotation angle value.

Figure 2:
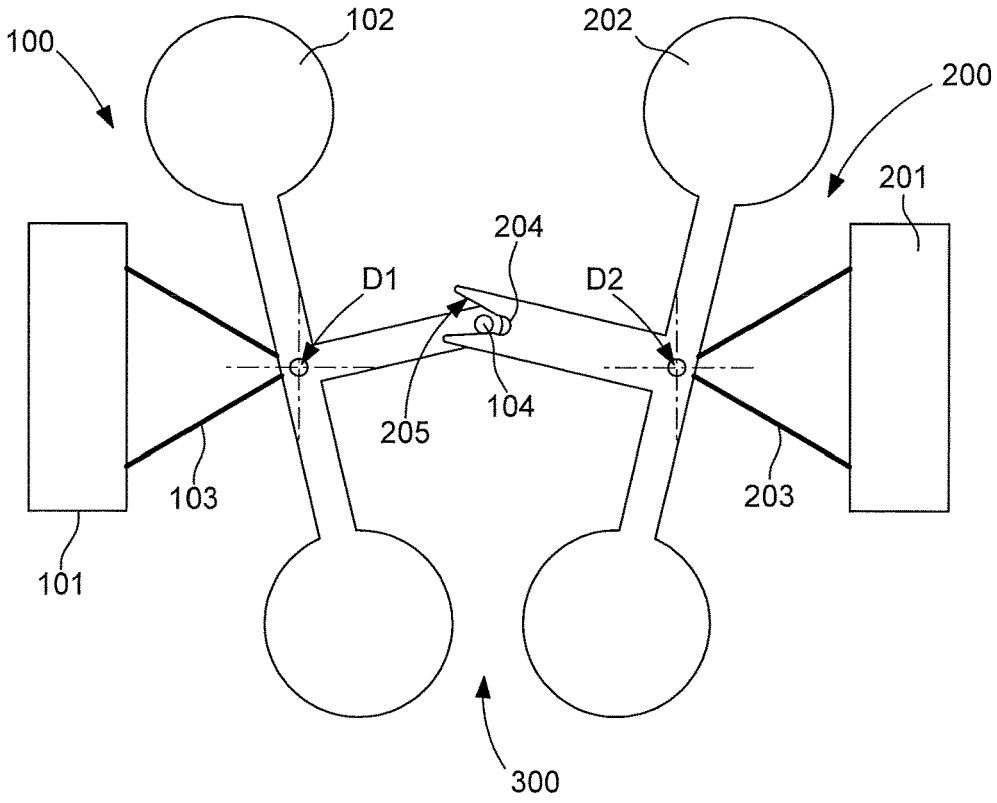
FIG. 2 represents, in a similar manner to FIG. 1, the same mechanism in an intermediate oscillation position.

Thus, as seen in FIGS. 1 and 2, the two resonators are synchronized by pin 104 mounted on a first arm of first inertial weight 102 of first resonator 100, whose first virtual pivot axis is designed D1. Pin 104 slides in slot 204 in a second arm of second inertial weight 202 of second resonator 200. There is a space between pin 104 and slot 204 so as to minimise friction. Slot 204 is V-shaped, widening towards its opening 205 away from second virtual pivot axis D2 of second inertial weight 202, this V-shape allows first resonator 100 and second resonator 200 to have the same opposite rotation angle, and prevents pin 104 and slot 204 touching each other, in order not to impair the mechanical efficiency of the resonator.

In case of rotary shock, first resonator 100 and second resonator 200 tend to rotate in the same direction, and the articulated connection prevents them doing so, which ensures proper operation of the escapement with which at least one of the two resonators cooperates. There is no untimely stopping, as would be the case of a single resonator on a short-stroke flexural pivot.

The resonator oscillations can be maintained in various ways.

Figure 3:
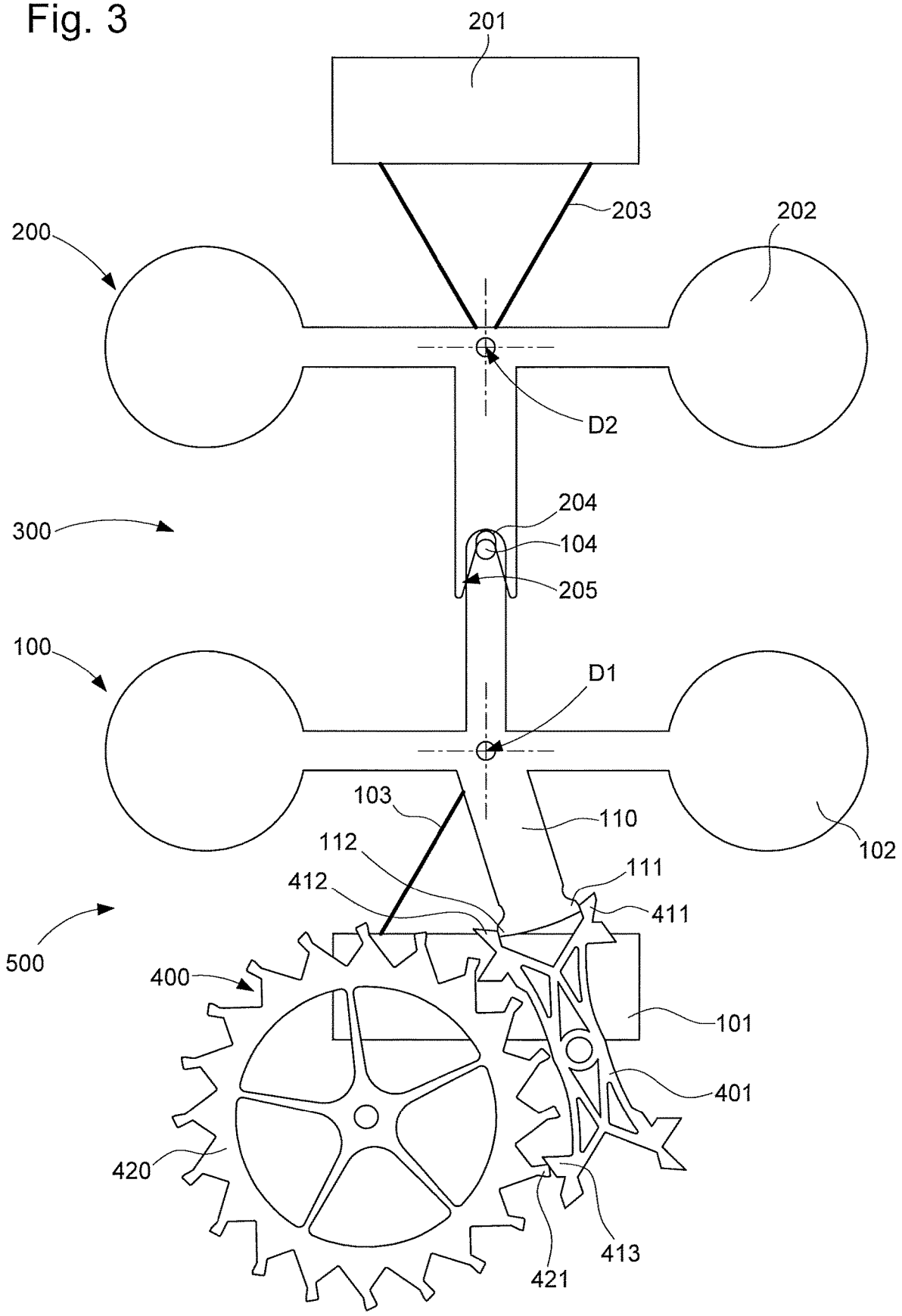
FIG. 3 represents, in a similar manner to FIG. 1, a similar mechanism, with an escapement on one of the resonators.

FIG. 3 illustrates the configuration in which regulating mechanism 300 includes an oscillator, which includes an escapement mechanism 400 and one of primary resonators 100, 200. The mechanical synchronizing means, notably in the pin/slot variant, as illustrated, are arranged to maintain the oscillations of every other primary resonator 100, 200; here first resonator 100 cooperates with escapement 400 and the oscillations of second resonator 200 are maintained by the first.

More particularly, this oscillator includes enlarged pallets 401, as described in European Patent Application No EP16200152 in the name of ETA Manufacture Horlogère Suisse, and in the Applications that depend thereon: PCT/EP2017/069037, PCT/EP2017/069038, PCT/EP2017/

069039, PCT/EP2017/069040, PCT/EP2017/069041, PCT/EP2017/069043, PCT/EP2017/078497, PCT/EP2017/080121.

An arm 110, comprised in primary resonator 100, 200 with which escapement mechanism 400 is arranged to cooperate—first resonator 100 in the case of FIG. 3—is arranged to cooperate with enlarged pallets 401.

A second means of maintaining the resonator oscillations is to use a frictional rest escapement, which acts alternately on first resonator 200 and second resonator 200.

Figure 4:
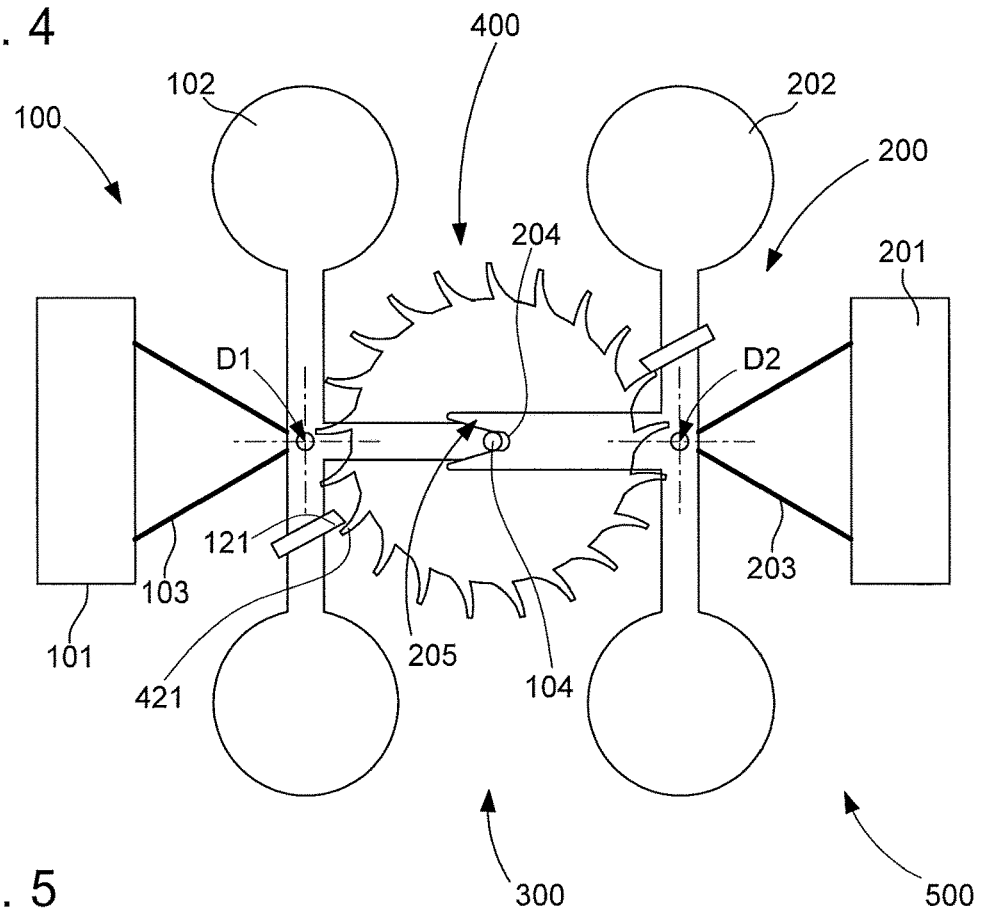
FIG. 4 represents, in a similar manner to FIG. 1, a similar mechanism, with an escapement on both resonators, in a first angular rest position of each resonator.
Figure 5:
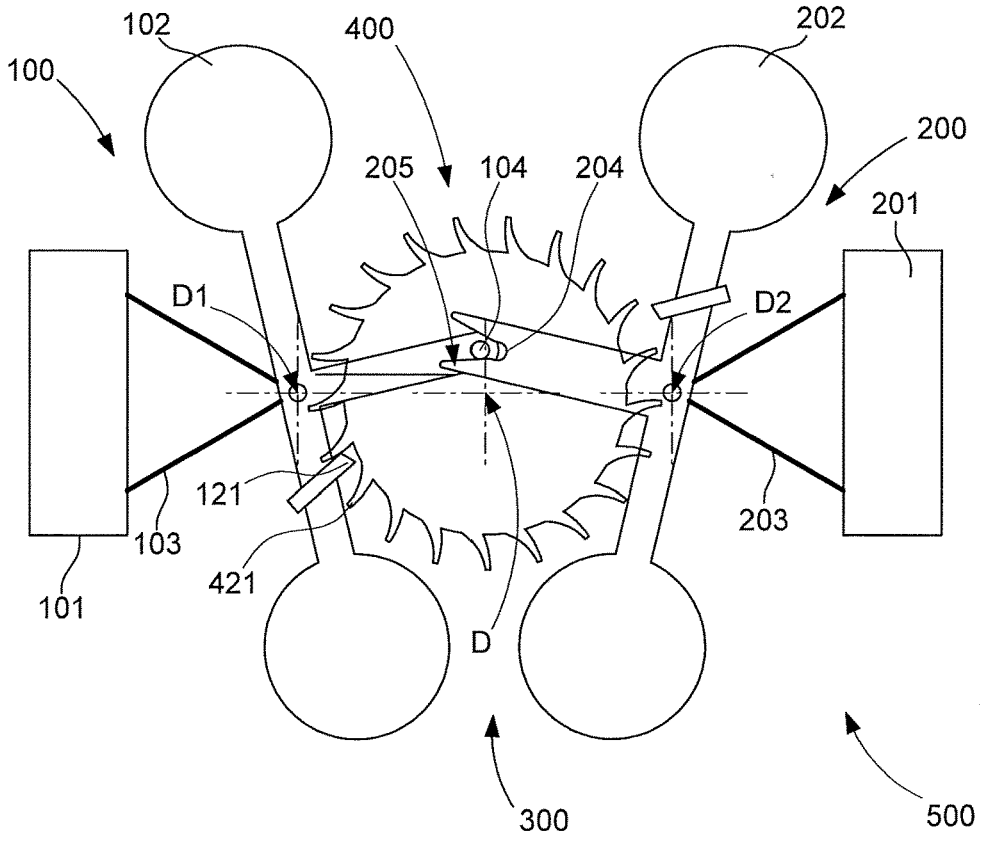
FIG. 5 represents, in a similar manner to FIG. 4, the same mechanism in an intermediate oscillation position.

Thus, according to the invention and as seen in FIGS. 4 and 5, regulating mechanism 300 includes an oscillator that includes a frictional rest escapement mechanism 400, which is arranged to cooperate alternately with two primary resonators 100, 200, on pallet stones 121, 221, comprised in the two inertial weights 102, 202 of these two primary resonators 100, 200.

This variant has many advantages.

Indeed, the energy is distributed equally over the two resonators. When the two primary resonators 100, 200 have the same frequency and poising adjustment, the articulated connection is only in mechanical contact in case of shock: pin 104 and slot 204 never touch each other, except in case of external disturbance. This makes it possible to minimise disruption to operation caused by friction between pin 104 and slot 204.

Preferably, the geometry of pallet stones 121, 221, is the same for both resonators, which makes it possible to optimise the friction paths. Compared to a conventional frictional rest escapement, in which both pallet stones are on the same mobile element, the configuration according to the invention, with one pallet stone per mobile element, makes it possible to choose a pallet stone geometry having the same efficiency, without being obliged to use the curved pallet stones known from the Graham deadbeat escapement. FIGS. 4 and 5 illustrate a preferred variant, with an escape wheel 420 with curved teeth 421, and arranged to cooperate with pallet stones 121, 221, which are straight. This configuration means pallet stones can be made from ruby, which remains economical, and it is possible to combine ruby pallet stones with a silicon or similar escape wheel 420 and thus to avoid the high contact forces of a silicon/silicon combination if curved pallet stones had to be made from silicon. Indeed, the silicon embodiment of escape wheel 420 remains very advantageous, since it minimises its inertia, which can be further improved with a maximum recess and minimum thickness. The pallet stones are thicker than the wheel and it is perfectly appropriate to make them from ruby using the traditional method.

Thus, more particularly, frictional rest escapement mechanism 400 includes an escape wheel 420 made of silicon and/or silicon dioxide, and pallet stones 121; 221 are made of ruby to minimise the contact forces between teeth 421 of escape wheel 420 and pallet stones 121, 221.

Figure 9:
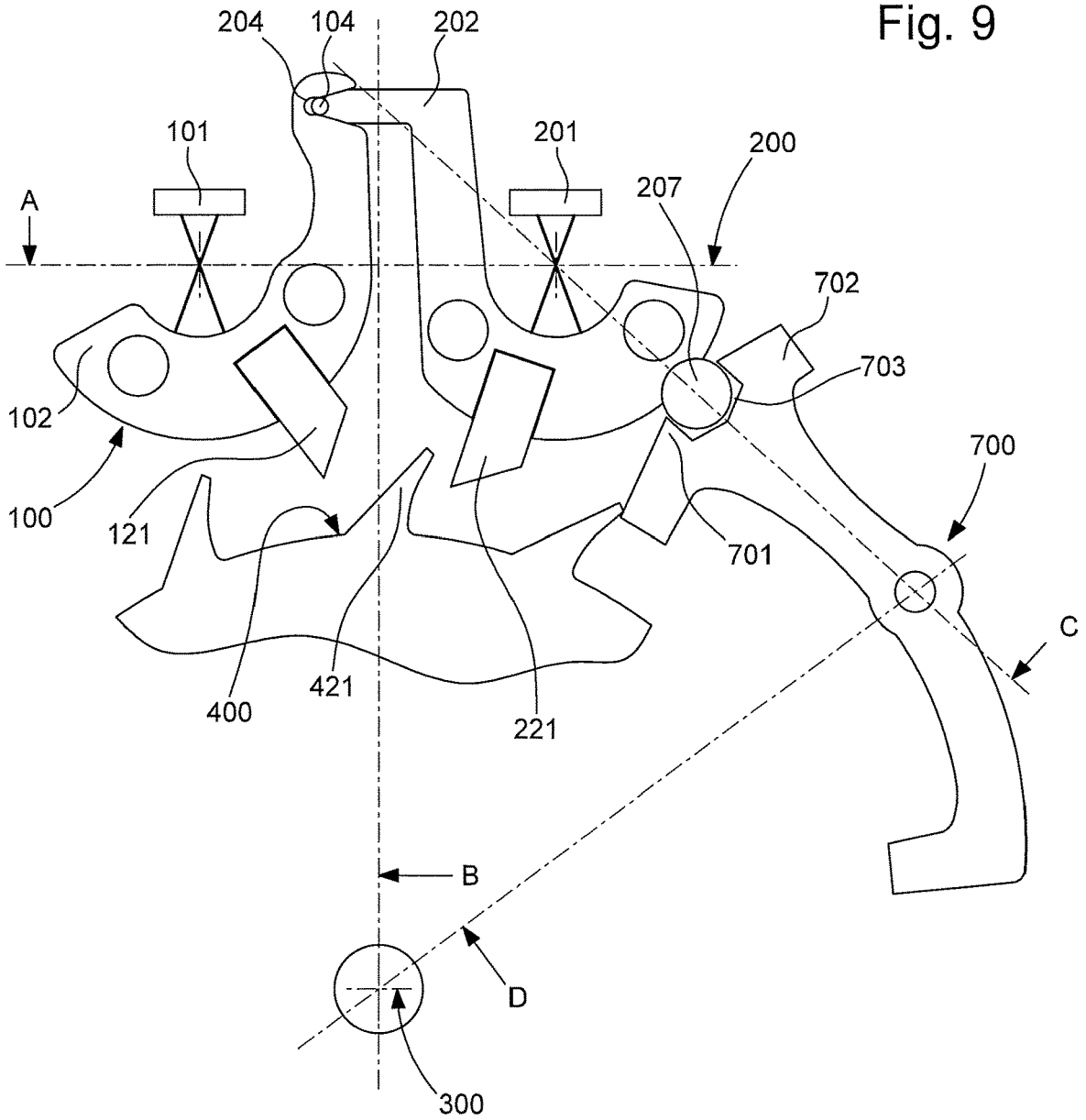
FIG. 9 represents, in a similar manner to FIG. 1, a similar mechanism, with a detached, direct, double tangential impulse escapement.
Figure 10:
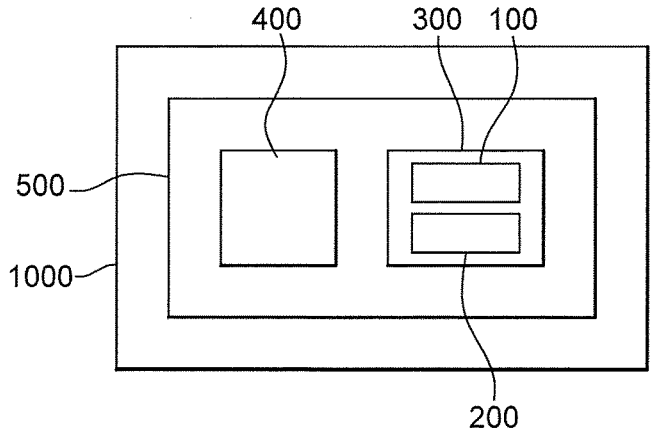
FIG. 10 is a block diagram representing a watch including a timepiece movement comprising such a regulating mechanism.

A third means of maintaining the resonator oscillations consists in using an articulated regulating mechanism 300, which includes an oscillator that includes a direct, double tangential impulse, detached escapement mechanism 400, as seen in FIG. 9. This regulating mechanism 300 includes a kinematic connection 600 between two inertial weights 102, 202 comprised in two primary resonators 100, 200 and which are arranged to pivot in opposite directions. These two inertial weights 102, 202 comprise pallet stones 121, 221, arranged to cooperate with teeth 421, comprised in an escape wheel 420 comprised in escapement mechanism 400, so as to produce a direct impulse from escape wheel 420 to one of pallet stones 121, 221 at each vibration of the oscillation. This kinematic connection 600 advantageously includes the articulated connection with play between the two inertial weights 102, 202.

This mechanism is comparable to a coaxial escapement, in which the direct impulse from the pallets is replaced here by a direct impulse on the inertial weight of the second resonator.

More particularly, in a variant illustrated by FIG. 9, regulating mechanism 300 includes a bistable stopper 700, which is arranged to cooperate, on the one hand, via a first arm 701, with one of teeth 421 to stop escape wheel 420, and on the other hand, via a fork 703, with a pin 207 comprised in one of the two inertial weights 102, 202. This stopper with two stable positions, which resembles a pallet lever, serves only for the lock function to stop the escape wheel via this first arm 701. The pivoting of the second inertial weight causes pin 207 to be released from fork 703, and then lets stopper 700 pivot, and thus allows rotation of the escape wheel.

According to this third means, escapement mechanism 400 is a detached escapement with a direct, double tangential impulse.

Indeed, it is detached since the resonator is free during part of its oscillation, which is favourable from a chronometric point of view.

It has a double impulse, since one impulse is produced at each vibration of the oscillation.

It has a tangential impulse, since the contact which produces the impulse occurs substantially on the line that connects the centre of inertia of the inertial weight concerned to the centre of the escape wheel (as opposed to the friction impulse of a conventional Swiss lever escapement).

It has a direct impulse since the impulse is given directly from the wheel to the resonator, without necessarily passing through pallets.

It is clear that this direct double impulse is possible only because the two inertial weights pivot in opposite directions. Thus, the escape wheel, which always rotates in the same direction, can push one of the inertial weights during the first vibration, and the other during the second vibration.

The dot and dash lines A, B, C, D of FIG. 9 illustrate relative advantageous arrangements: straight line A joining the virtual pivots of two flexural bearings is perpendicular to direction B coming from the centre of the escape wheel which is the bisection of these two pivots, the impulse between a tooth 421 and a pallet stone 121, 221, occurring close to this straight line B: one of the pivots defines with the axis of stopper 700 a straight line C perpendicular to straight line D joining the axis of the escape wheel and the axis of the stopper; the contact between pin 207 and fork 703 occurs in proximity to this straight line C.

With regard to the flexural pivots, various configurations can be used.

Figure 6:
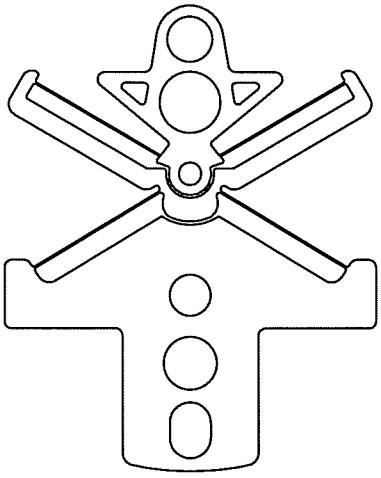
FIG. 6 represents a schematic, plan view of a flexural bearing in the form of a top-to-tail V-shaped pivot.

FIG. 6 illustrates the case where the plurality of flexible strips 103, 203, includes at least one pivot including head-to-tail V shapes, this configuration being known to be insensitive to the positions of the watch.

Figure 8:
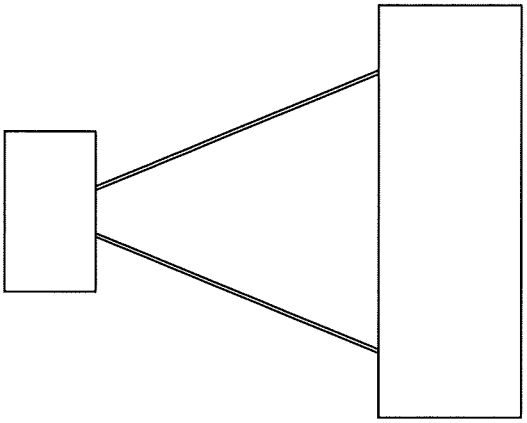
FIG. 8 represents a schematic, plan view of a flexure bearing in the form of a Wittrick-type pivot.

FIG. 8 illustrates the case where the plurality of flexible strips 103, 203, includes at least one pivot having strips in two parallel planes that cross in projection, this configuration also being known to be insensitive to the positions of the watch, in specific angle and crossing point conditions.

Figure 7:
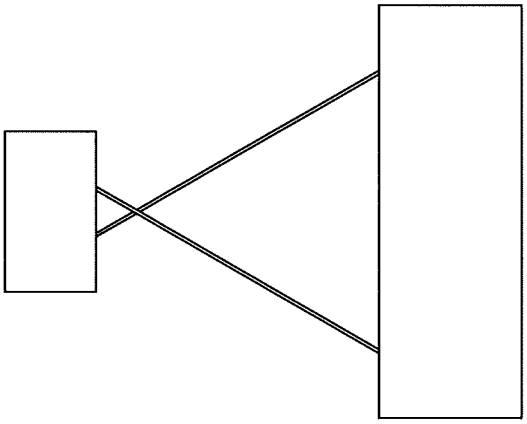
FIG. 7 represents a schematic, plan view of a flexural bearing in the form of a pivot with strips that cross in projection.

FIG. 7 illustrates the case where the plurality of flexible strips 103, 203 include at least one V-shaped Wittrick-type pivot, which is known to be sensitive to the positions of the watch during wear. However, owing to the means of synchronizing with the articulated connection, this configuration can also be used, since the articulated connection removes position sensitivity. This variant is particularly simple to make.

The invention also concerns a timepiece movement 500 including at least one such timepiece regulating mechanism 300.

The invention also concerns a watch 1000 including at least one such movement 500, and/or at least one such timepiece regulating mechanism 300.

The invention claimed is:

1. A timepiece regulating mechanism comprising:

a plurality of primary resonators, including a first primary resonator and a second primary resonator, the first primary resonator including at least one first inertial weight, which is pivotable with respect to a first fixed structure to which said first inertial weight is suspended by a plurality of first flexible strips, and the second primary resonator including at least one second inertial weight, which is pivotable with respect to a second fixed structure to which said second inertial weight is suspended by a plurality of second flexible strips, said first fixed structure being spaced apart and separate from said second fixed structure, wherein said regulating mechanism includes mechanical means of synchronization of at least said first and second primary resonators which include an articulated connection between said first and second inertial weights comprised in said first and second primary resonators, which articulated connection is arranged, under normal conditions, to allow pivoting of said first and second inertial weights in opposite directions of rotation and with close rotation angle values, and is arranged to prevent, during a shock, pivoting of said first and second inertial weights in the same direction of rotation, wherein said regulating mechanism includes an oscillator which includes a frictional rest escapement mechanism which is arranged to cooperate alternately with said first and second primary resonators, on pallet stones comprised in said first and second inertial weights of said first and second primary resonators.

2. The timepiece regulating mechanism according to claim 1, wherein said articulated connection is a connection in which there is play.

3. The timepiece regulating mechanism according to claim 1, wherein one of said first and second inertial weights comprises a pin that slides with play in a slot comprised in the other of said first and second inertial weights, said slot being V-shaped so as to allow, under normal conditions, pivoting of said first and second inertial weights in opposite directions of rotation and with the same rotation angle value.

4. The timepiece regulating mechanism according to claim 1, wherein said first and second primary resonators have the same frequency and poising adjustment, and wherein said articulated connection is only in mechanical contact in case of shock.

5. The timepiece regulating mechanism according to claim 1, wherein said frictional rest escapement mechanism comprises an escape wheel with teeth which are curved and arranged to cooperate with said pallet stones which are straight.

6. The timepiece regulating mechanism according to claim 1, wherein said frictional rest escapement mechanism comprises an escape wheel made of silicon and/or silicon dioxide, and wherein said pallet stones are made of ruby so as to minimise the contact forces between the teeth of said escape wheel and said pallet stones.

7. The timepiece regulating mechanism according to claim 1, wherein said first and second plurality of flexible strips comprises at least one position insensitive pivot including head-to-tail V-shaped portions.

8. The timepiece regulating mechanism according to claim 1, wherein said first and second plurality of flexible strips comprises at least one position insensitive pivot with strips in two parallel planes that cross in projection.

9. The timepiece regulating mechanism according to claim 1, wherein said first and second plurality of flexible strips comprises at least one Wittrick-type V-shaped pivot, wherein said articulated connection removes position sensitivity.

10. A timepiece movement comprising one of the timepiece regulating mechanism according to claim 1.

11. A watch comprising the timepiece movement according to claim 10.

* * * * *